US009931650B2

(12) United States Patent
Butzke et al.

(10) Patent No.: US 9,931,650 B2
(45) Date of Patent: Apr. 3, 2018

(54) SHOWER HAVING MULTI-CHANNEL JET OUTLET UNITS

(71) Applicant: Hansgrohe SE, Schiltach (DE)

(72) Inventors: Klaus Butzke, Schiltach (DE); Marc Kalmbach, Aichhalden (DE)

(73) Assignee: Hansgrohe SE, Schiltach (DE)

( * ) Notice: Subject to any disclaimer, the term of this patent is extended or adjusted under 35 U.S.C. 154(b) by 37 days.

(21) Appl. No.: 15/110,837

(22) PCT Filed: Jan. 12, 2015

(86) PCT No.: PCT/EP2015/050435

§ 371 (c)(1),
(2) Date: Jul. 11, 2016

(87) PCT Pub. No.: WO2015/107028

PCT Pub. Date: Jul. 23, 2015

(65) Prior Publication Data

US 2016/0332173 A1 Nov. 17, 2016

(30) Foreign Application Priority Data

Jan. 16, 2014 (DE) ..... 10 2014 200 741

(51) Int. Cl.
*A62C 31/00* (2006.01)
*B05B 1/18* (2006.01)
(Continued)

(52) U.S. Cl.
CPC ..... *B05B 1/185* (2013.01); *B05B 1/06* (2013.01); *B05B 1/16* (2013.01); *B05B 1/1627* (2013.01);
(Continued)

(58) Field of Classification Search
CPC .. B05B 1/185; B05B 1/06; B05B 1/16; B05B 7/06; B05B 1/1627; B05B 1/1636; B05B 9/01; B05B 15/061
(Continued)

(56) References Cited

U.S. PATENT DOCUMENTS 1,733,054 A * 10/1929 Crill ..... B05B 1/18 239/423
5,246,301 A 9/1993 Hirasawa
(Continued)

FOREIGN PATENT DOCUMENTS

| | | |
|---|---|---|
| CN | 202860725 U | 4/2013 |
| EP | 2684610 A1 | 1/2014 |
| WO | 2008038315 A1 | 4/2008 |

*Primary Examiner* — Steven J Ganey
(74) *Attorney, Agent, or Firm* — Duane Morris LLP

(57) ABSTRACT

The invention relates to a spray device having a fluid outlet structure that forms a spray jet, said fluid outlet structure having a plurality of jet outlet units of which at least two are configured as multi-duct jet outlet units having in each case at least one first outlet duct and at least one second outlet duct fluidically separated from the first. Moreover, the spray device has a fluid guide which is designed to conduct a fluid supplied to the spray device selectively to the first outlet ducts or to the second outlet ducts. According to the invention, a minimum spacing ($A_{12}$) between the outlet ducts of each particular multi-duct jet outlet unit (2) is smaller than a minimum spacing between the outlet ducts of in each case two multi-duct jet outlet units, and/or in at least one multi-duct jet outlet unit, a second outlet duct or a group of a plurality of second outlet ducts is arranged so as to surround a first outlet duct at least around a part of its circumference.

11 Claims, 8 Drawing Sheets

Figure 6:
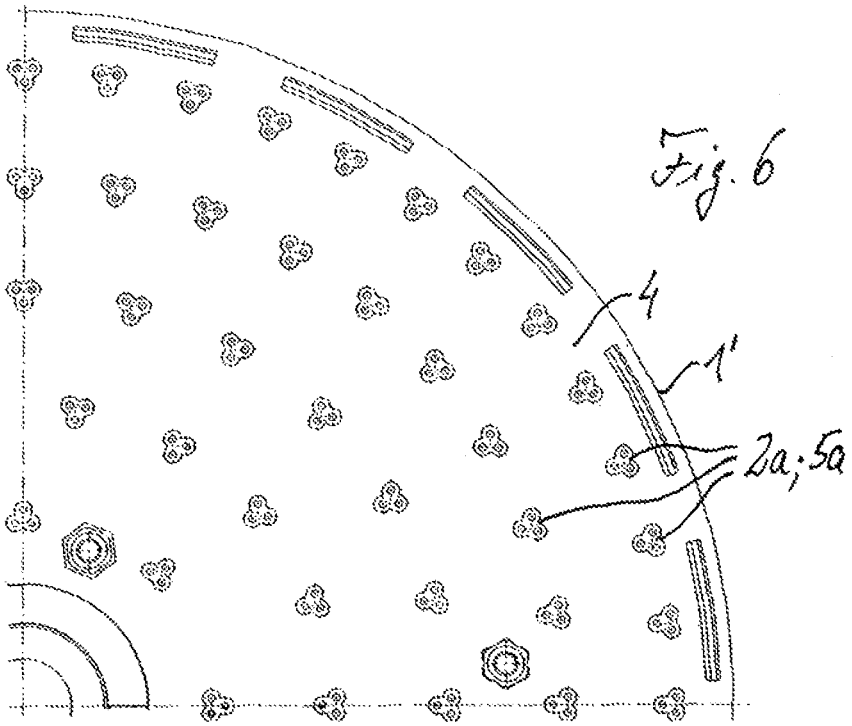

(51) Int. Cl.

| | |
|---|---|
| ***B05B 1/16*** | (2006.01) |
| ***B05B 9/01*** | (2006.01) |
| ***B05B 7/06*** | (2006.01) |
| ***B05B 15/06*** | (2006.01) |
| ***B05B 1/06*** | (2006.01) |

(52) U.S. Cl.
CPC ..... *B05B 1/1636* (2013.01); *B05B 7/06* (2013.01); *B05B 9/01* (2013.01); *B05B 15/061* (2013.01)

(58) Field of Classification Search
USPC ..... 239/423, 424, 443, 444, 446, 447, 525, 239/530, 549
See application file for complete search history.

(56) References Cited

U.S. PATENT DOCUMENTS

| | | | | |
|---|---|---|---|---|
| 7,344,095 | B1 * | 3/2008 | Hsu | B05B 1/1618 239/444 |
| 2001/0023901 | A1 * | 9/2001 | Haverstraw | B05B 1/044 239/443 |
| 2011/0121098 | A1 | 5/2011 | Luettgen | |
| 2013/0193238 | A1 | 8/2013 | Yu | |

* cited by examiner

Fig. 1
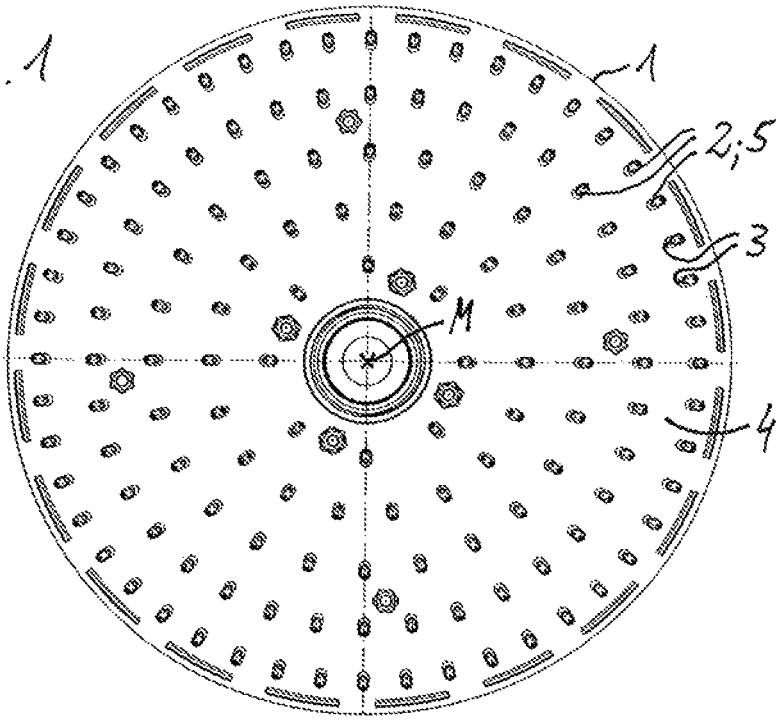
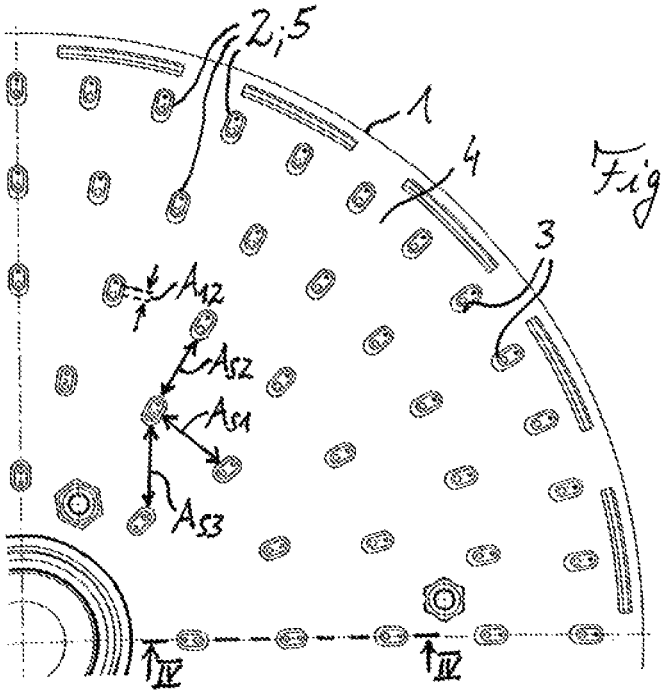
Fig. 2

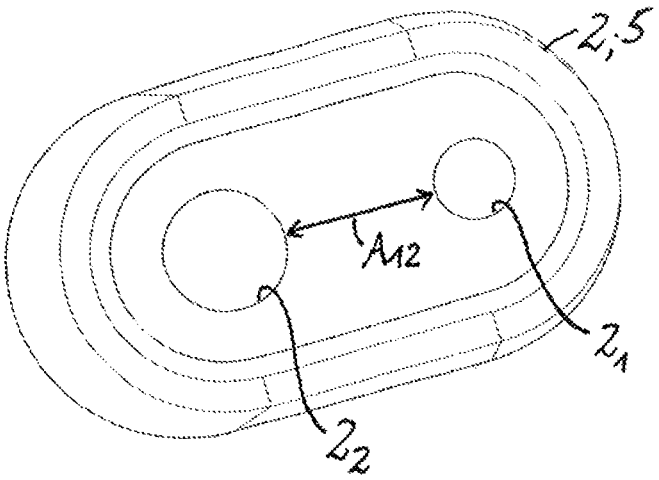
Fig. 3
Fig. 4
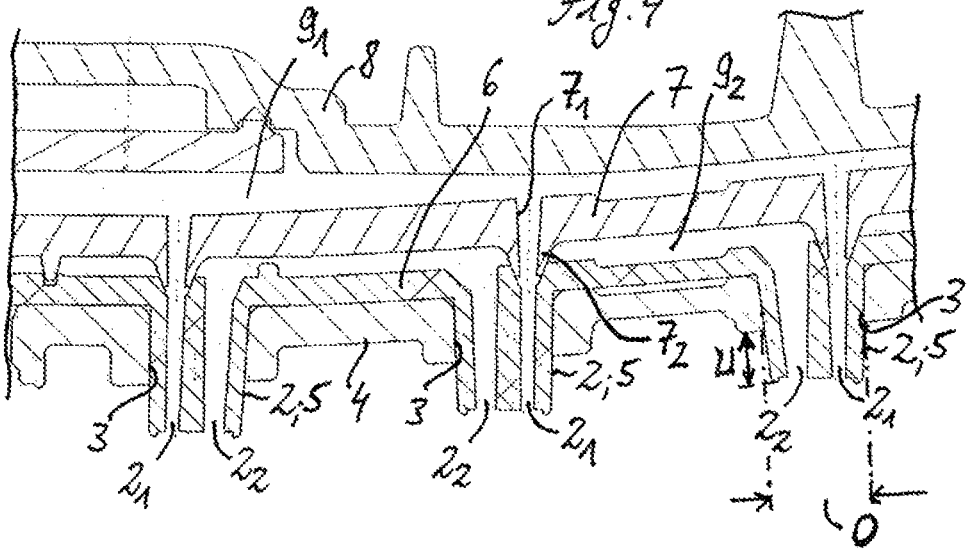
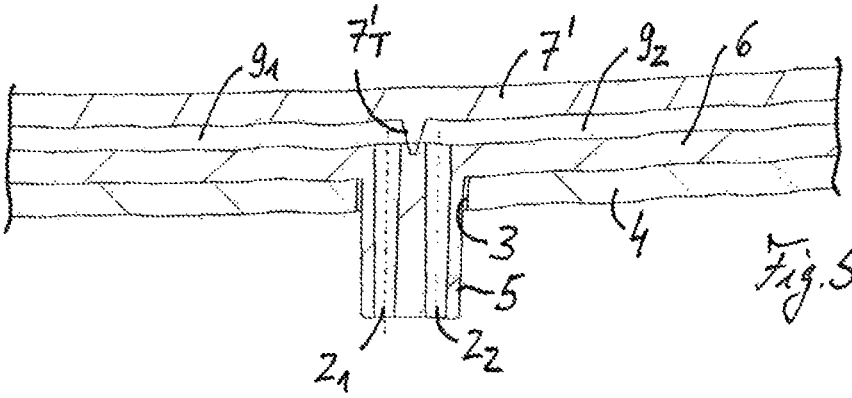
Fig. 5

Fig. 8
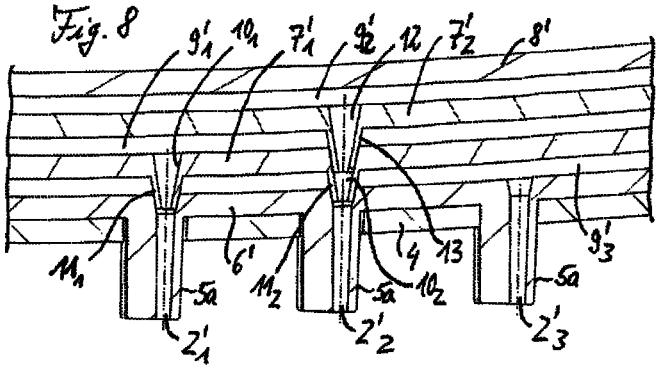
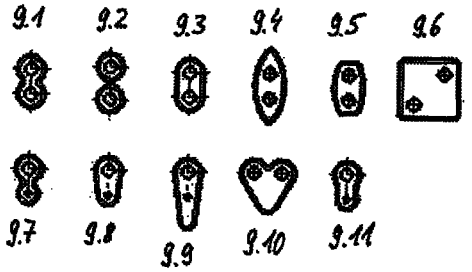
Fig. 9
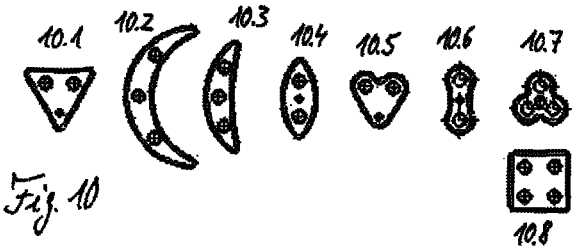
Fig. 10

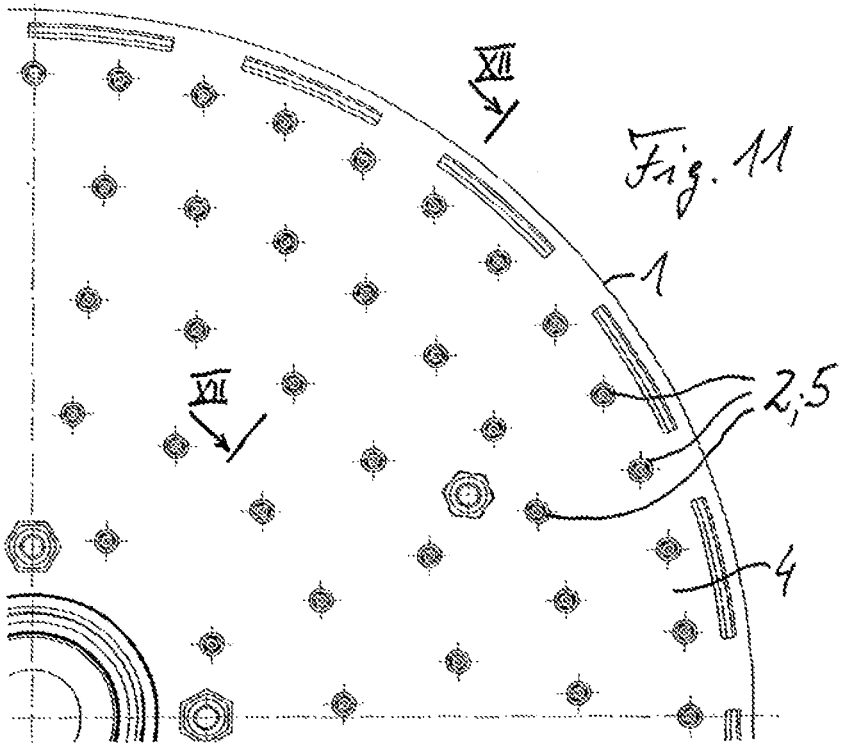
Fig. 11
Fig. 12
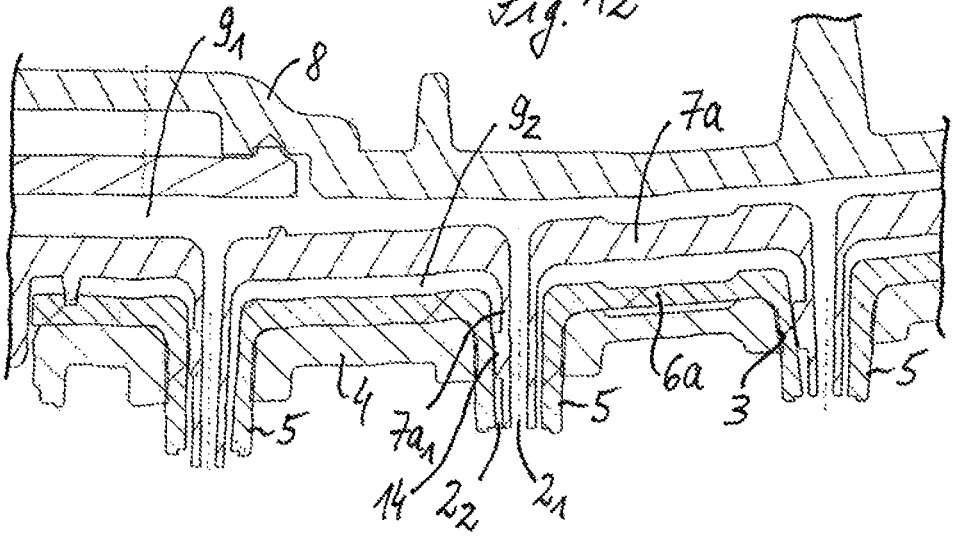

SHOWER HAVING MULTI-CHANNEL JET OUTLET UNITS

The invention relates to a spray device having a fluid outlet structure that forms a spray jet, said fluid outlet structure having a plurality of jet outlet units of which at least two are configured as multi-duct jet outlet units having in each case at least one first outlet duct and at least one second outlet duct fluidically separated from the first. Moreover, the spray device has a fluid guide which is designed to conduct a fluid supplied to the spray device selectively to the first outlet ducts or to the second outlet ducts. This includes embodiments in which the fluid is supplied only to the first outlet ducts in a first operating mode and only to the second outlet ducts in a second operating mode, or in which the fluid is supplied only to the first or only to the second outlet ducts in a first operating mode and to the first and the second outlet ducts in a second operating mode, or which comprise three operating modes in order to supply the fluid either only to the first or only to the second or to the first and second outlet ducts. Spray devices of this type are used in particular as sanitary shower spray devices, such as overhead spray devices, handheld spray devices and wall or side spray devices.

In a known sanitary handheld spray device of the type mentioned at the beginning, two-duct jet outlet elements are provided in a central region, said jet outlet elements being arranged at a regular circumferential spacing along a circular line around a longitudinal center axis of the spray device. The central region of the spray device is surrounded by an annular spray-device region in which one-duct jet outlet elements are provided. The two-duct jet outlet elements are formed from a plastics material, have a conical-oval shape and contain two outlet ducts, arranged alongside one another, with different circular diameters. The outlet ducts with a smaller diameter are located in the narrower oval end region of the jet outlet elements and are arranged along a radially inner circular line, and the outlet ducts with a larger diameter are located in the wider oval end region of the jet outlet elements and are arranged along a radially outer circular line of the central spray-device region. In this case, the spacing between the smaller outlet ducts of in each case two adjacent jet outlet elements is smaller than the spacing between these two jet outlet elements and is also smaller than the spacing between the two outlet ducts of each particular jet outlet element. In a first operating mode, shower water passes as an unaerated jet only out of the radially inner, smaller outlet ducts, and in a second operating mode, it passes as an aerated jet only out of the radially outer, larger outlet ducts.

Also known are shower spray devices which have several groups of one-duct jet outlet units and in which supplied shower water is conducted selectively to one or the other group in order to be able to achieve different spray jet characteristics in corresponding operating modes. Each group is fluidically connected to an associated outlet chamber, wherein the outlet chambers are arranged in a fluidically separated manner alongside one another or in succession with regard to a jet outlet direction.

The invention is based on the technical problem of providing a spray device of the type mentioned at the beginning, with which different spray jets can be set in a novel manner and which can be produced and cleaned in a comparatively simple manner.

The invention achieves this and other objects by providing a spray device comprising a fluid outlet structure that forms a spray jet, said fluid outlet structure comprising a plurality of iet outlet units of which at least two are configured as multi-duct jet outlet units having in each case at least one first outlet duct and at least one second outlet duct fluidically separated from the first. The spray device further comprises a fluid guide which is designed to conduct a fluid supplied to the spray device selectively to the first outlet ducts or to the second outlet ducts.

According to one aspect of the invention, a minimum spacing between the outlet ducts of each particular multi-duct jet outlet unit is smaller than a minimum spacing between the outlet ducts of in each case two multi-duct jet outlet units, and in a corresponding development of the invention also smaller than a minimum spacing between in each case two multi-duct jet outlet units themselves. In advantageous configurations, the minimum spacing between the outlet ducts in question can be smaller than the minimum spacing between in each case two jet outlet units by a factor of two or an even greater factor, for example by around a factor of five or ten or more.

According to a further aspect of the invention, in at least one multi-duct jet outlet unit, a second outlet duct or a group of a plurality of second outlet ducts is arranged such that it/they surround(s) a first outlet duct of this jet outlet unit at least around a part of its circumference, i.e. around a part of its circumference or around its entire circumference.

With the spray device according to the invention, it is possible to set different spray jets or spray jet patterns in that, by way of a corresponding fluid guide of the spray device, the supplied fluid, such as shower water, is conducted selectively to the first outlet ducts or to the second outlet ducts of each particular multi-duct jet outlet unit. Thus, in corresponding embodiments of the invention, spray jets can be set with active use of only the first or only the second outlet ducts or both the first and the second outlet ducts. Furthermore, the spray device according to the invention can be cleaned and freed of limescale comparatively easily, since the outlet ducts used for the different spray jet patterns are combined to form the multi-duct jet outlet units and can extend therein in a parallel manner in terms of flow, wherein the outlet ducts of each multi-duct jet outlet unit are relatively close together, in particular closer than the multi-duct jet outlet units themselves, and/or wherein the second outlet ducts are arranged around the first outlet ducts. In addition, this combination of the first and second outlet ducts in the particular jet outlet units can make it easier to manufacture the spray device and can increase its operational reliability.

In one development of the invention, not only the minimum spacing but also a maximum spacing between the outlet ducts of each particular multi-duct jet outlet unit is smaller than a minimum spacing between the outlet ducts of in each case two multi-duct jet outlet units and in a further configuration is also smaller than a minimum spacing between in each case two multi-duct jet outlet units themselves. This represents an advantageously close arrangement of the first and the second outlet ducts relative to one another, compared with the spacing between in each case two jet outlet units. In advantageous configurations, the maximum spacing between the outlet ducts in question can be smaller than the minimum spacing between in each case two jet outlet units by a factor of two or an even greater factor, for example by around a factor of five or ten or more.

In one development of the invention, an orifice of the at least one second outlet duct is at the same level as an orifice of the at least one first outlet duct with respect to a jet outlet direction or has a predetermined offset relative thereto. Both alternative measures can have advantages for example with regard to jet characteristics and cleanability when tailored to the particular application.

In one development of the invention, in at least one multi-duct jet outlet unit, a second outlet duct annularly surrounds a first outlet duct, or a group of a plurality of second outlet ducts surround a first outlet duct at a regular spacing from one another along a closed curve, for example along a circular or elliptical or oval curve. As a result, advantageous jet patterns can be achieved in which the different individual jets, which are provided by the first outlet duct or by the second outlet duct(s) of each particular jet outlet unit, scarcely differ in position at the spray device outlet on account of their close arrangement, although they can have different jet characteristics, for example an aerated jet on the one hand and an unaerated jet on the other.

In one development of the invention, the fluid outlet structure of the spray device contains a jet disk which has an associated jet disk opening for each jet outlet unit. This means that, for each multi-duct jet outlet unit, only in each case one opening in the jet disk is required. In one configuration of this measure, each particular jet outlet unit is formed by a jet outlet element extending through the associated jet disk opening. By realizing the jet outlet element in a corresponding manner, the jet outlet unit can be provided as a multi-duct jet outlet unit. As an alternative to this realization of the jet outlet unit by a separate jet outlet element that is present in addition to the jet disk, each particular jet outlet unit can also be formed as an integral constituent directly on the jet disk itself by appropriate design of the jet disk.

In a further configuration of the invention, the fluid outlet structure contains a jet-forming structure arranged on an inner side of the jet disk, the jet outlet elements being arranged on said jet-forming structure, wherein the jet outlet elements consist of an elastic material. This has an advantageous effect on the production cost, the operational reliability and the cleanability of the spray device.

In this case, it can be particularly advantageous if, in a further configuration of the invention, the jet outlet elements extend on the outlet side beyond an outer side of the jet disk with a projecting length of at least a quarter of an opening width of the jet disk openings. In particular, in corresponding embodiments of the invention, the projecting length can correspond to at least a third or at least half of the opening width of the jet disk openings. This contributes to easier cleanability.

In one development of the invention, the first outlet ducts, for the one part, and the second outlet ducts, for the other part, are assigned respective fluidically separated outlet chambers, out of which the outlet ducts in question lead, wherein the outlet chambers are arranged alongside one another or in succession with regard to a jet outlet direction, mostly an axial direction of the spray device or a spray-device longitudinal direction. This represents an advantageous possibility for conducting the supplied fluid selectively to the first or second outlet ducts.

In one development of the invention, at least one of the multi-duct jet outlet units has at least one third outlet duct fluidically separated from the at least one first and the at least one second outlet duct. With this variant embodiment, different spray jet patterns can consequently be realized, with selective use of one or more of the at least three outlet ducts of each multi-duct jet outlet unit. In one configuration of this measure, the jet outlet unit in question has in each case one first, second and third outlet duct, and the three outlet ducts are arranged alongside one another in a linear or triangular configuration. In this way, different spray jet patterns can be set in an advantageous manner.

Figure 7:
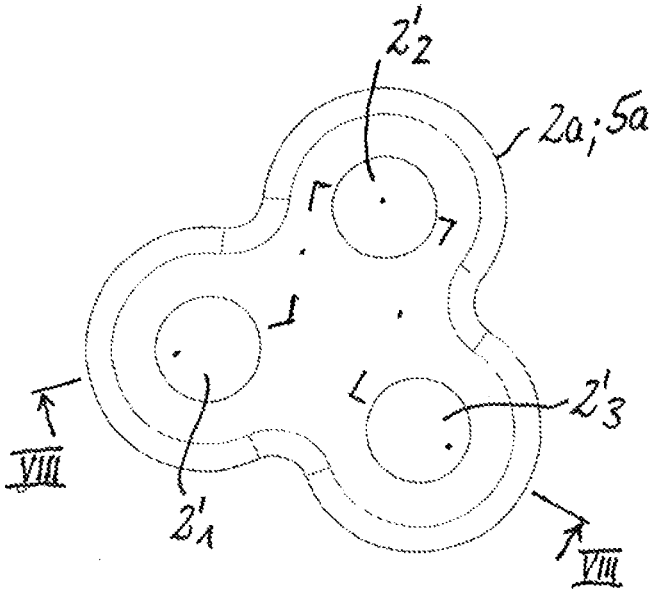
Figure 13:
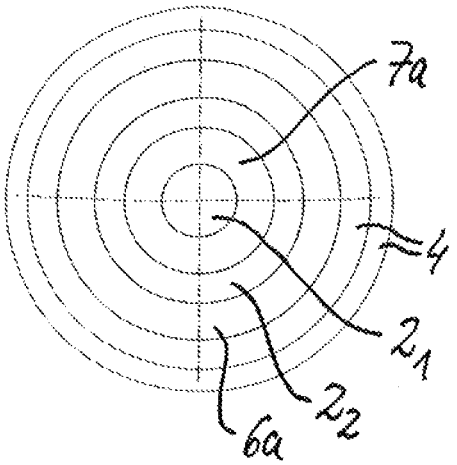
Figure 14:
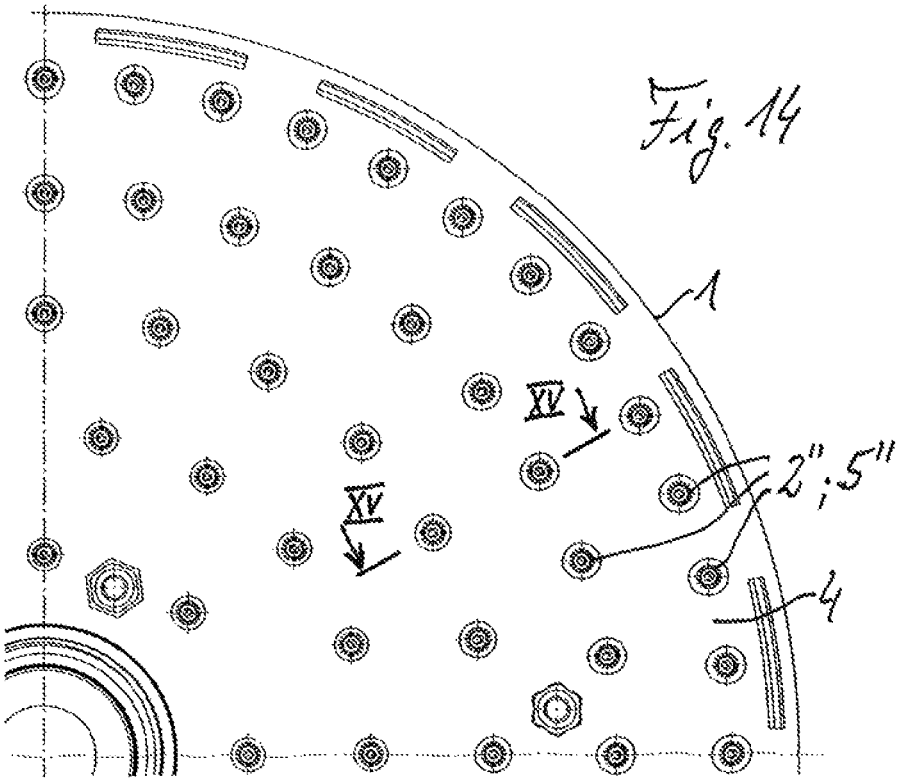
Figure 15:
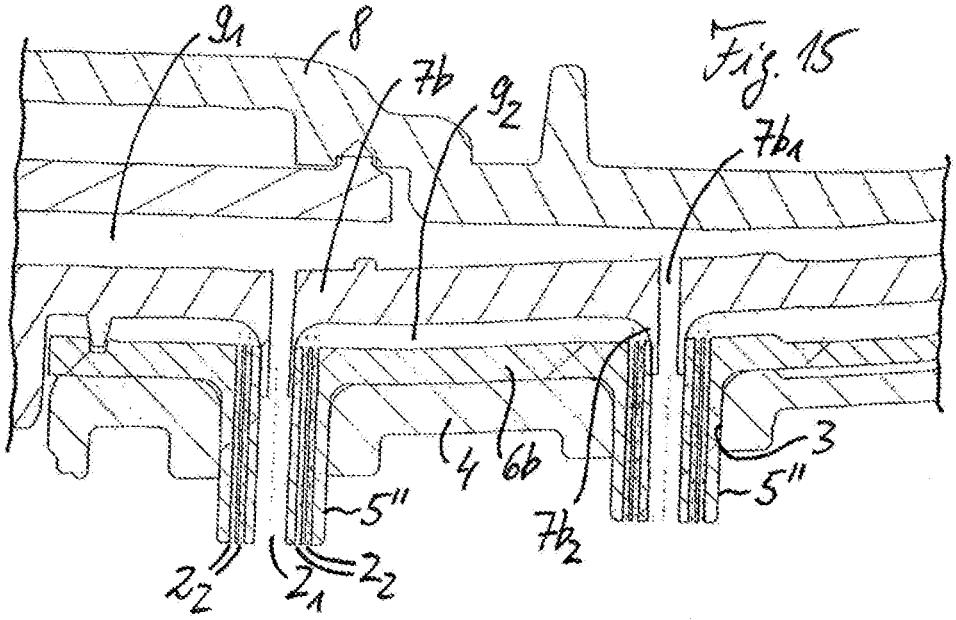
Figure 16:
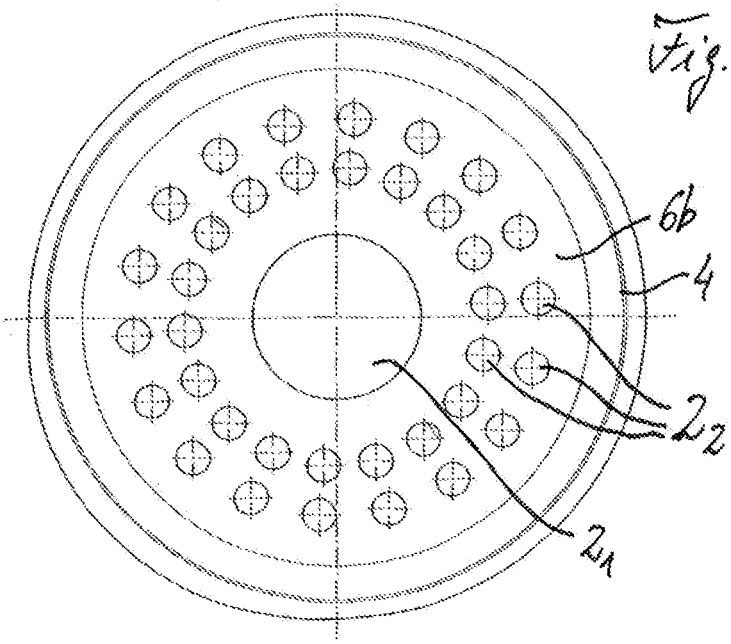
Figure 17:
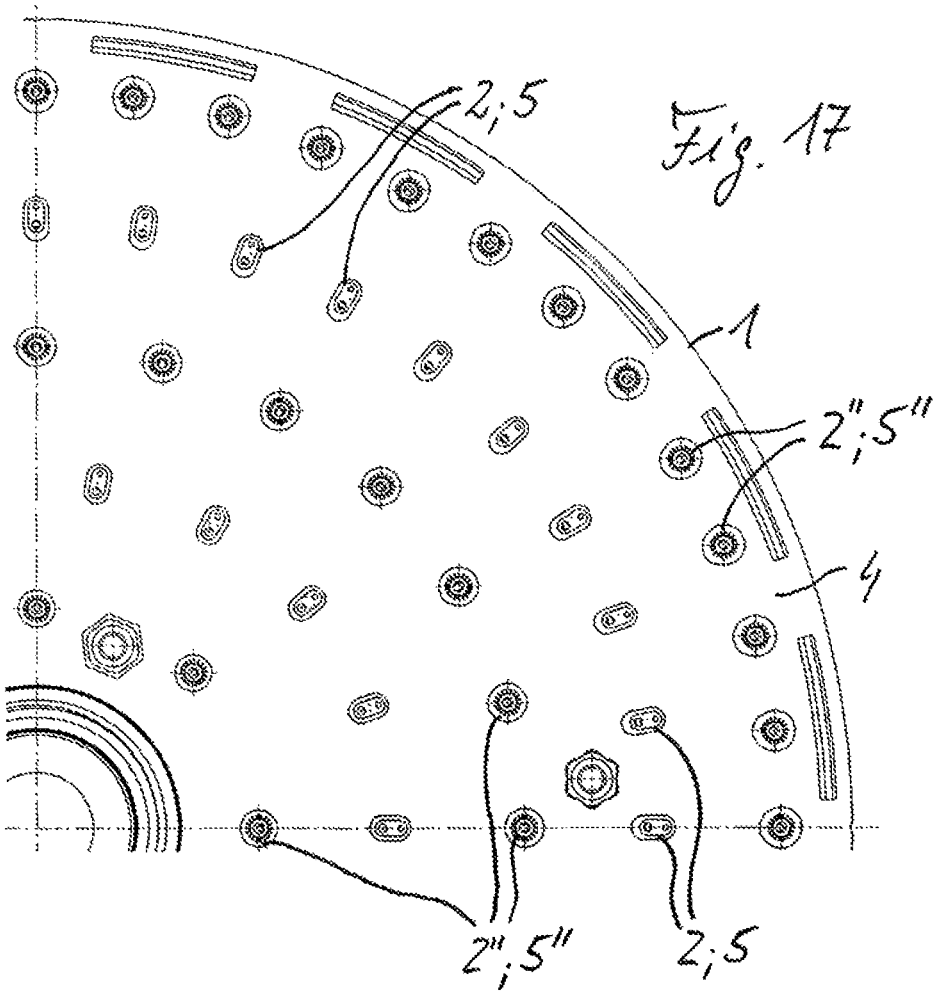

Advantageous embodiments of the invention are described in the following text and illustrated in the drawings, in which:

FIG. 1 shows a plan view of a jet outlet side of a spray device having two-duct jet outlet elements, FIG. 2 shows an enlarged quarter-circle view of FIG. 1, FIG. 3 shows a perspective detail view of one of the jet outlet elements used in the spray device in FIG. 1, FIG. 4 shows a sectional view along a line IV-IV in FIG. 2, FIG. 5 shows a sectional view corresponding to FIG. 4 for a variant embodiment having outlet chambers located alongside one another rather than in succession, FIG. 6 shows a quarter-circle view corresponding to FIG. 2 for a variant embodiment having three-duct jet outlet elements, FIG. 7 shows a plan view of one of the three-duct jet outlet elements in FIG. 6, FIG. 8 shows a sectional view along a line VIII-VIII in FIG. 7, FIG. 9 shows, in subfigures 9.1 to 9.11, plan views of various two-duct jet outlet elements that are usable according to the invention, FIG. 10 shows, in subfigures 10.1 to 10.8, plan views of various three-duct and four-duct jet outlet elements that are usable according to the invention, FIG. 11 shows a quarter-circle view corresponding to FIG. 2 for a variant embodiment having jet outlet elements which have a central first outlet duct and a second outlet duct coaxial therewith, FIG. 12 shows a sectional view along a line XII-XII in FIG. 11, FIG. 13 shows a plan view of the region of one of the jet outlet elements of the spray device in FIG. 11, FIG. 14 shows a quarter-circle view corresponding to FIG. 2 for a variant embodiment having jet outlet elements in which a central outlet duct is surrounded by a plurality of second outlet ducts, FIG. 15 shows a sectional view along a line XV-XV in FIG. 14, FIG. 16 shows a plan view of the region of one of the jet outlet elements of the spray device in FIG. 14, and FIG. 17 shows a quarter-circle view corresponding to FIG. 2 for a variant embodiment having two different types of multi-duct jet outlet elements.

Various embodiments of the invention are explained in more detail in the following text with reference to the corresponding figures, wherein the same reference signs are used for identical and functionally equivalent elements for the sake of easier understanding. FIGS. 1 to 4 illustrate a spray device that is usable for example as a sanitary shower spray device, for instance as a handheld spray device, overhead spray device or wall or side spray device, wherein only that part of the spray device that is of interest here is shown in the figures. Otherwise, the spray device can have any desired conventional structure.

As can be seen from FIGS. 1 to 4, the spray device includes a spray-device body which ends on the fluid-outlet side with a fluid outlet structure 1 that forms a spray jet, said fluid outlet structure 1 having a plurality of jet outlet units 2. The fluid outlet structure 1 ends on the outside with a jet disk 4 which is circular in the example shown and has an associated jet disk opening 3 for each jet outlet unit 2. As can be seen especially in FIGS. 1 and 2, the jet disk openings 3 and therefore the jet outlet elements 2 are arranged in a manner distributed substantially regularly over the jet disk surface, along five different radii in the example shown. In the example shown in FIGS. 1 to 4, all of the jet outlet units 2 are configured as two-duct jet outlet units with in each case one first outlet duct $\mathbf{2}_1$ and one second outlet duct $\mathbf{2}_2$ that is fluidically separated therefrom. Alternatively, it is also possible for only some of the jet outlet units to be configured as two-duct jet outlet units and for the rest to be configured as one-duct jet outlet units.

In the example shown, the two-duct jet outlet units 2 are arranged such that their two outlet ducts $\mathbf{2}_1$, $\mathbf{2}_2$ are located on different radii of the jet disk 4, specifically substantially on radial lines which proceed from a center point M of the jet disk 4. An axis that passes through this disk center point M perpendicularly to the plane of the drawing in FIG. 1 forms a longitudinal center axis of the spray device, which corresponds to a jet outlet direction, i.e. a direction in which a fluid jet passes out of the spray device with a main direction component during operation. In the example shown, in the case of the jet outlet units 2 located on the innermost radius, the first outlet ducts $\mathbf{2}_1$ are located closer to the disk center point M than the second outlet ducts $\mathbf{2}_2$, while the reverse is the case for the other four radii, i.e. the second outlet duct $\mathbf{2}_2$ is located closer to the disk center point M there than the first outlet duct $\mathbf{2}_1$ of each particular jet outlet unit 2. It goes without saying that, as an alternative, any other desired arrangement patterns and orientations are possible within the scope of the invention for the positioning of the jet outlet units 2 over the surface of the jet disk 4.

The two outlet ducts $\mathbf{2}_1$, $\mathbf{2}_2$ of each particular jet outlet unit 2 are arranged at a spacing $A_{12}$ from one another. The jet outlet units 2 are arranged at spacings $A_{S1}$, $A_{S2}$, $A_{S3}$, etc. from one another on the jet disk 4, wherein these spacings $A_{S1}$, $A_{S2}$, $A_{S3}$ can be different from one another. As can be seen from FIG. 2, the spacing $A_{12}$ between the two outlet ducts $\mathbf{2}_1$, $\mathbf{2}_2$ of each two-duct jet outlet unit 2 is smaller than even a minimum value of the spacings $A_{S1}$, $A_{S2}$, $A_{S3}$, etc. of in each case two two-duct jet outlet units 2, however, and thus also smaller than a minimum spacing between the outlet ducts $\mathbf{2}_1$, $\mathbf{2}_2$ of in each case two two-duct jet outlet units 2, i.e. smaller than a minimum spacing of any desired outlet duct $\mathbf{2}_1$, $\mathbf{2}_2$ of any desired multi-duct jet outlet unit 2 from any desired outlet duct $\mathbf{2}_1$, $\mathbf{2}_2$ of any other jet outlet unit 2.

In the example shown, the mutual spacing $A_{12}$ between the two outlet ducts $\mathbf{2}_1$, $\mathbf{2}_2$ of each jet outlet unit 2 is smaller than the minimum spacing of in each case two jet outlet units 2 from one another by more than a factor of five. It goes without saying that the invention also includes embodiments in which there is not just a single, constant spacing between the first and second outlet ducts of each jet outlet unit, but in which this spacing varies, for example from jet outlet unit to jet outlet unit. However, in such cases, too, provision is made for the minimum spacing between the outlet ducts of each particular multi-duct jet outlet unit to remain smaller than a minimum spacing between the outlet ducts of in each case two multi-duct jet outlet units. Preferably, provision is furthermore made for a maximum spacing between the outlet ducts of each particular multi-duct jet outlet unit also to still remain smaller than the minimum spacing between the outlet ducts of in each case two multi-duct jet outlet units.

As can be seen in more detail from FIG. 4, in the example shown, each particular jet outlet unit 2 is formed by a jet outlet element 5 extending through the associated jet disk opening 3, said jet outlet element being produced from an elastic material. The jet outlet elements 5 are formed integrally with an outlet plate 6 formed from the elastic material, wherein they protrude therefrom as nipples and the outlet plate 6 is pressed from the inside against the jet disk 4 in such a way that the nipples or jet outlet elements 5 extend through the jet disk openings 3. In this case, the jet outlet elements 5 protrude beyond the outer side of the jet disk 4 with a projecting length U. This projecting length U is preferably at least a quarter of a maximum opening width O of the jet disk openings, i.e. 4U≥O. In the example shown, the projecting length U is more than half the opening width O. The projecting length U contributes to good cleanability of the jet outlet elements 5, in particular with regard to limescale in the outlet ducts $\mathbf{2}_1$, $\mathbf{2}_2$ thereof.

In the example shown, the two outlet ducts $\mathbf{2}_1$, $\mathbf{2}_2$ of the two-duct jet outlet unit 2 have different, circular opening diameters; in alternative embodiments of the invention they can also have identical diameters. Typical diameters of the jet outlet ducts $\mathbf{2}_1$, are between about 0.3 mm and about 2 mm. In the example shown, the jet outlet elements or jet outlet nipples 5 have an elliptical cross-sectional shape, as can be seen in FIG. 3, wherein their two outlet ducts $\mathbf{2}_1$, $\mathbf{2}_2$ are provided in the opposite oval end regions.

In addition to the jet disk 4 and to the outlet plate 6, the fluid outlet structure 1 has a chamber-forming plate 7 and a chamber end plate 8 which adjoin the outlet plate 6 on the inner side thereof facing the jet disk 4. Formed between the chamber end plate 8 and the outlet plate 6 is a free space which is subdivided by the chamber-forming plate 7 into a first outlet chamber $\mathbf{9}_1$ and a second outlet chamber $\mathbf{9}_2$, fluidically separated therefrom, wherein the two outlet chambers $\mathbf{9}_1$, are arranged in succession with regard to the abovementioned jet outlet direction or spray-device longitudinal-axis direction. The second outlet ducts $\mathbf{2}_2$ of the jet outlet elements 5 are fluidically connected to the second outlet chamber $\mathbf{9}_2$ formed between the outlet plate 6 and the chamber-forming plate 7, and the first outlet ducts $\mathbf{2}_1$ are fluidically connected to the first outlet chamber $\mathbf{9}_1$ formed between the chamber-forming plate 7 and the chamber end plate 8.

In addition, the chamber-forming plate 7 has, in the region of the first outlet ducts $\mathbf{2}_1$, associated, aligned through-ducts $\mathbf{7}_1$ and sealing connectors $\mathbf{7}_2$, wherein each particular through-duct $\mathbf{7}_1$ extends, with the sealing connector $\mathbf{7}_2$ surrounding it on the outlet side, into a conical inlet region of the associated first outlet duct $\mathbf{2}_1$, and the sealing connector $\mathbf{7}_2$ presses in a sealing manner, with a correspondingly conical outer surface, against this mouth region of the outlet plate 6 and as a result seals off the first outlet duct $\mathbf{2}_1$, together with its through-duct $\mathbf{7}_1$, from the second outlet chamber $\mathbf{9}_2$.

FIG. 5 shows a variant which differs from the spray device in FIGS. 1 to 4 by way of the fluid outlet structure and in particular by way of the formation of the outlet chambers $\mathbf{9}_1$, $\mathbf{9}_2$ connected to the two fluid outlet chambers $\mathbf{2}_1$, $\mathbf{2}_2$ of each particular jet outlet element 5. Specifically, in the example in FIG. 5, the two outlet chambers $\mathbf{9}_1$, $\mathbf{9}_2$ are arranged alongside one another with regard to the jet outlet direction. In addition, in the thus modified fluid outlet structure, a modified chamber-forming plate 7' adjoins the outlet plate 6 on its side remote from the jet disk 4, forming a free space which is subdivided by a suitable separating web structure $\mathbf{7'}_T$ into the two fluidically separated outlet chambers $\mathbf{9}_1$, $\mathbf{9}_2$. In addition, the separating web structure $\mathbf{7'}_T$ extends, in the region of each particular two-duct jet outlet element 5, along a zone between the first outlet duct $\mathbf{2}_1$ and the second outlet duct $\mathbf{2}_2$, wherein the separating web structure $\mathbf{7'}_T$ is pressed against the outlet plate 6 in a sealing manner. This ensures that the first outlet duct $\mathbf{2}_1$ leads out of the first outlet chamber $9_1$ and the second outlet duct $2_2$ of each particular jet outlet element 5 leads out of the second outlet chamber $9_2$ in a manner fluidically separated therefrom.

In a conventional manner, the spray device according to FIGS. 1 to 4 and also the spray device according to FIG. 5 comprise a fluid guide which is designed to conduct a fluid supplied to the spray device selectively to the first outlet ducts $2_1$ or to the second outlet ducts $2_2$. This contains the fluid outlet structure 1 and suitable upstream components, for instance a switchover valve or the like, in order to guide the fluid selectively into the first outlet chamber $9_1$ and/or into the second outlet chamber $9_2$. As a result of a corresponding system design, two or more operating modes can then be realized as required for these spray-device variants, for example an operating mode in which the fluid emerges only from the first outlet ducts $2_1$, an operating mode in which the fluid emerges only from the second outlet ducts $2_2$, and/or an operating mode in which the fluid emerges both from the first and from the second outlet ducts $2_1$, $2_2$.

As an alternative to the shown provision of the jet outlet units 2 by the jet outlet elements 5 made of elastic material, the jet outlet units 2 can also be provided directly on the jet disk 4 by the jet disk 4 being designed in a corresponding manner in these regions. This also applies with regard to the other exemplary embodiments shown and can be realized in corresponding variant embodiments for example in that the jet disk is manufactured as a one-piece elastic element structured in this way or as a two-component plastics element with elastically configured jet outlet nipples or as a jet disk made of a hard material which is provided with a coating made of elastic material from which the jet outlet nipples project.

It goes without saying that the invention also includes spray devices with jet outlet units which have more than two fluidically separated outlet ducts. In this regard, FIGS. 6 to 8 show an exemplary embodiment with three-duct jet outlet units 2*a*. In this example, the three-duct jet outlet units 2*a* are realized by cross-sectionally cloverleaf-shaped jet outlet elements 5*a* made of elastic material, which are again formed as protruding nipples integrally on and together with a thus modified outlet plate 6'. Each jet outlet element 5*a* has three fluidically separated outlet ducts $2'_1$, $2'_2$, $2'_3$ which are provided in a triangular configuration in the region of in each case one of the three cloverleaf roundings. In this example, too, as can be seen in FIG. 6, the minimum spacing of the outlet ducts $2'_1$, $2'_2$, $2'_3$ of each particular jet outlet unit 2*a* from one another is much smaller than the minimum spacing between in each case two jet outlet units 2*a*.

As part of a fluid guide that is suitable for this purpose, a thus modified fluid outlet structure 1' has, adjoining the outlet plate 6' on its side remote from the jet disk 4, a first chamber-forming plate $7'_1$, a second chamber-forming plate $7'_2$ and a chamber end plate 8', such that three fluidically separated outlet chambers $9'_1$, $9'_2$, $9'_3$ that are located in succession in the jet outlet direction are formed, wherein a first outlet chamber $9'_1$ between the two chamber-forming plates $7'_1$, $7'_2$ is fluidically connected to the first outlet ducts $2'_1$, a second outlet chamber $9'_2$ between the second chamber-forming plate $7'_2$ and the chamber end plate 8' is fluidically connected to the second outlet ducts $2'_2$, and a third outlet chamber $9'_3$ between the outlet plate 6' and the first chamber-forming plate $7'_1$ is fluidically connected to the third outlet ducts $2'_3$. In this case, the first chamber-forming plate $7'_1$ has, aligned with the first and second outlet ducts $2'_1$, $2'_2$, associated conical through-openings $10_1$, $10_2$ and, on the side thereof facing the outlet plate 6', protruding sealing connectors $11_1$, $11_2$, by way of which the through-openings $10_1$, $10_2$ lead into the first and second outlet ducts $2'_1$, $2'_2$, respectively, of the jet outlet elements 5*a* through the third outlet chamber $9_3$ in a sealed-off manner and thus in a manner fluidically separated therefrom. The second chamber-forming plate $7'_2$ has, aligned with the second outlet ducts $2'_2$, associated through-openings 12 and corresponding sealing connectors 13, by way of which the through-openings 12 lead into the through-openings $10_2$, located beneath the first outlet chamber $9'_1$, of the first chamber-forming plate $7'_1$ through the first outlet chamber $9'_1$ in a sealed-off manner. In addition, the through-openings $10_2$ and the sealing connectors 13 that lead into them have a correspondingly conical shape here, too.

It goes without saying that, as an alternative to the arrangement of the outlet chambers $9'_1$, $9'_2$, $9'_3$ in succession, the latter can also be arranged in only one or in two planes rather than three planes, for which purpose in each case a correspondingly modified fluid outlet structure is used. In this case, all three outlet chambers can then be arranged alongside one another, or two outlet chambers are arranged alongside one another and a third outlet chamber is arranged in front of or behind the latter.

It also goes without saying that the invention is not limited to the specific designs and embodiments of multi-channel jet outlet units mentioned thus far, but includes further variants. By way of example, FIGS. 9 and 10 respectively show plan views of jet outlet units and jet outlet elements, forming the latter, having in each case two, three or four outlet ducts. Specifically, subfigure 9.1 in FIG. 9 shows a two-duct jet outlet element having an eight-shaped cross section. Subfigure 9.2 shows a two-duct jet outlet element similar to subfigure 9.1 with a narrowed central region. Subfigure 9.3 shows a two-duct jet outlet element similar to that in FIG. 3, but with equally large outlet ducts. Subfigure 9.4 shows a jet outlet element having a pointed oval cross-sectional shape, subfigure 9.5 a jet outlet element having an oblate oval cross-sectional shape. Subfigure 9.6 shows a two-duct jet outlet element having a square cross-sectional shape. Subfigure 9.7 shows a two-duct jet outlet element similar to subfigure 9.1 but with an irregularly eight-shaped cross section. Subfigure 9.8 shows a two-duct jet outlet element having a rounded conical cross-sectional shape. Subfigure 9.9 shows a jet outlet element similar to subfigure 9.8 but with a lengthened conical cross-sectional shape. Subfigure 9.10 shows a two-duct jet outlet element having a heart-shaped cross section. Subfigure 9.11 shows a two-duct jet outlet element having a keyhole-shaped cross section.

Subfigures 10.1 to 10.6 show various three-duct jet outlet elements having a triangular cross section (subfigure 10.1), a crescent-shaped cross section (subfigure 10.2), a curved cross-sectional shape with less of a crescent shape (subfigure 10.3), a pointed oval cross section (subfigure 10.4), a heart-shaped cross section (subfigure 10.5) and an eight-shaped cross section (subfigure 10.6), respectively. Subfigure 10.7 shows a four-duct jet outlet element having a cloverleaf-shaped cross section, and subfigure 10.8 shows a four-duct jet outlet element having a square cross section.

FIGS. 11 to 13 illustrate a further variant embodiment of a spray device having two-duct jet outlet units 2, which are formed in this case by jet outlet elements 5 which have a central first outlet duct $2_1$ and a second outlet duct $2_2$ coaxially surrounding the latter around its entire circumference. In addition, in this example, only an outer periphery of each particular jet outlet element 5 is integrally formed as an integral extension on a thus modified outlet plate 6*a* made of elastic material. A cavity extension $7a_1$ engages in an opening free space formed by this outer periphery of the jet outlet element 5, said cavity extension $7a_1$ being formed in an aligned manner with the facing side of a thus modified channel-forming plate 7*a* and having a central duct which forms the first outlet duct $2_1$. An annular duct that remains between this cavity extension $7a_1$ and the outer periphery of the jet outlet element 5 forms the second outlet duct $2_2$. The cavity extension $7a_1$ extends forward to approximately the same level as the outer periphery of the jet outlet element 5, such that both outlet ducts $2_1$, $2_2$ lead out at approximately the same level. Supporting webs 14, which are formed on the outer side of the cavity extension $7a_1$, ensure that the cavity connector $7a_1$ remains centered in the opening free space surrounded by the outer periphery of the jet outlet element 5.

It is apparent again for example from FIGS. 11 and 12 that the spacing between the first and the second outlet duct $2_1$, $2_2$ of each jet outlet unit 2 is much smaller than the minimum spacing between in each case two jet outlet units 2.

Otherwise, the spray device in FIGS. 11 to 13 corresponds substantially to the one in FIGS. 1 to 4. In both cases, individual jets with different characteristics for the outlet from the first outlet ducts $2_1$ and from the second outlet ducts $2_2$ can be provided as required, for example a harder, unaerated jet from the central, first outlet ducts $2_1$ and a softer, aerated jet from the annular second outlet ducts $2_2$. In alternative embodiments, the second outlet duct $2_2$ does not surround the first outlet duct $2_1$ around its entire circumference but only around a partial circumference, i.e. through an angular range of less than 360°.

FIGS. 14 to 16 illustrate a spray-device variant having multi-duct jet outlet elements and in particular a plurality of second outlet ducts per jet outlet unit. Specifically, in the jet outlet in FIGS. 14 to 16, a plurality of jet outlet units 2" are provided, which are each formed by a jet outlet element 5" which has a central first outlet duct $2_1$ and a plurality of second outlet ducts $2_2$ that surround the first outlet duct $2_1$ in a coaxial or concentric arrangement. In the example shown, the second outlet ducts $2_2$ of each jet outlet element 5" are arranged equidistantly about the first outlet duct $2_1$ along two circular lines with different radii.

In addition, a modified outlet plate 6*b* is provided, on which the jet outlet elements 5" are again formed integrally as corresponding extensions or outlet nipples, wherein both the first outlet duct $2_1$, as a central hollow duct, and the plurality of second outlet ducts $2_2$, as corresponding, narrower hollow ducts, are formed in this nipple structure axially in the annular nipple wall surrounding the first outlet duct $2_1$. In this case, the second outlet ducts $2_2$ extend rearward into the associated second outlet chamber $9_2$ between the outlet plate 6*b* and a modified duct-forming plate 7*b*, which, in a similar manner to the duct-forming plate 7 of the spray device in FIGS. 1 to 4, is provided with through-openings $7b_1$ that are aligned with the first outlet ducts $2_1$, wherein corresponding sealing connectors $7b_2$ seal off the connection of the through-openings $7b_1$ to the first outlet ducts $2_1$ of the jet outlet elements 5" with respect to the second outlet chamber $9_2$.

Here, too, it is clear for example from figure that the minimum distance between the first and second outlet ducts $2_1$, $2_2$ of each particular jet outlet unit 2" is much smaller than the minimum distance of in each case two jet outlet units 2" from one another.

With this spray device, a spray jet in which the fluid emerges only from the first outlet ducts $2_1$ can be provided for example in a first operating mode, or a spray jet in which the fluid emerges only from the second outlet ducts $2_2$ can be provided in a second operating mode, wherein the spray jet is composed in this case of a corresponding multiplicity of individual jets per jet outlet element 5".

Although spray devices have hitherto been described which each have only one type of jet outlet elements, the invention also includes embodiments with a plurality of different types of jet outlet elements. It goes without saying here that, depending on the requirements, as many different types and shapes of jet outlet units as desired can be used for each particular spray device. To this end, FIG. 17 illustrates a simple example in which two types of jet outlet units are used, specifically the two-duct jet outlet units 2, or jet outlet elements 5, used in the spray device in FIGS. 1 to 4 and the multi-duct jet outlet units 2", or jet outlet elements 5", used in the spray device in FIGS. 14 to 16. In the example of FIG. 17, the two types of jet outlet units 2, 2" alternate on five different jet disk radii, i.e. the multi-duct jet outlet units 2" are arranged at a respectively equidistant spacing from one another on an innermost, a central and an outer radius, and the two-duct jet outlet units 2 are arranged at an equidistant spacing on the two intermediate radii. The associated fluid outlet structure is formed in a manner corresponding thereto, as is readily clear to a person skilled in the art from the illustrations of the spray devices in FIGS. 1 to 4 and FIGS. 14 to 16, respectively.

The invention claimed is:

1. A spray device, comprising:

a fluid outlet structure that forms a spray jet, said fluid outlet structure comprising a plurality of jet outlet units of which at least two are configured as multi-duct jet outlet units having in each case at least one first outlet duct and at least one second outlet duct fluidically separated from the first outlet duct, and a fluid guide which is designed to conduct a fluid supplied to the spray device selectively to the first outlet ducts or to the second outlet ducts, wherein a minimum spacing between the at least one first outlet duct and the at least one second outlet duct of each particular multi-duct jet outlet unit is smaller than a minimum spacing between the outlet ducts of in each case two multi-duct jet outlet units, or in at least one multi-duct jet outlet unit, at least one of the at least one second outlet duct and a group of a plurality of the at least one second outlet ducts of the particular multi-duct jet outlet unit, is arranged so as to surround at least one said at least one first outlet duct at least around a part of a circumference of the first outlet duct.

2. The spray device as claimed in claim 1, wherein a maximum spacing between the at least one first outlet duct and the at least one second outlet duct of each particular multi-duct jet outlet unit is smaller than a minimum spacing between the outlet ducts of in each case two different multi-duct jet outlet units, or an orifice of the at least one second outlet duct is at the same level as an orifice of the at least one first outlet duct with respect to a jet outlet direction or has a predetermined offset relative thereto.

3. The spray device as claimed in claim 1, wherein in at least one multi-duct jet outlet unit, at least one of the second outlet duct annularly surrounds the first outlet duct thereof, or a group of a plurality of the at least one second outlet ducts of the particular multi-duct jet outlet unit, surround at least one said at least one first outlet duct at a regular spacing from one another along a closed curve.

4. The spray device as claimed in claim 1, wherein the fluid outlet structure comprises a jet disk which has an associated jet disk opening for each of the jet outlet units.

5. The spray device as claimed in claim 4, wherein each particular said jet outlet unit is formed by a jet outlet element extending through the associated jet disk opening.

6. The spray device as claimed in claim 5, wherein the fluid outlet structure comprises a jet-forming structure arranged on an inner side of the jet disk, the jet outlet elements, which comprise an elastic material, being arranged on said jet-forming structure.

7. The spray device as claimed in claim 5, wherein the jet outlet elements extend on an outlet side beyond an outer side of the jet disk with a projecting length of at least a quarter of an opening width of the jet disk openings.

8. The spray device as claimed in claim 1, wherein the fluid outlet structure comprises at least one first outlet chamber, out of which the first outlet ducts lead, and at least one second outlet chamber, fluidically separated from the first, out of which the second outlet ducts lead, and wherein the first and the second outlet chambers are arranged one of alongside one another and in succession with regard to a jet outlet direction.

9. The spray device as claimed in claim 1, wherein at least one of the multi-duct jet outlet units has at least one third outlet duct fluidically separated from the at least one first and the at least one second outlet duct.

10. The spray device as claimed in claim 9, wherein the jet outlet unit with the at least one third outlet duct has in each case one first, second and third outlet duct, these being arranged alongside one another in one of a linear configuration and a triangular configuration.

11. The spray device as claimed in claim 1, wherein the spray device is configured as a sanitary shower spray device.

* * * * *